US005313379A

United States Patent [19]

Lemons et al.

[11] Patent Number: 5,313,379

[45] Date of Patent: May 17, 1994

[54] ASYMMETRIC SPORT LIGHTING LUMINAIRE

[75] Inventors: Thomas M. Lemons, Marblehead, Mass.; Kenneth M. Spink, Jerome, Mich.

[73] Assignee: Qualite Sports Lighting, Inc., Hillsdale, Mich.

[21] Appl. No.: 31,073

[22] Filed: Mar. 11, 1993

Related U.S. Application Data

[63] Continuation-in-part of Ser. No. 915,240, Jul. 20, 1992, abandoned.

[51] Int. Cl.[5] ..... F21V 7/00

[52] U.S. Cl. ..... 362/298; 362/301; 362/346; 362/359

[58] Field of Search ..... 362/261, 263, 297, 301, 362/342, 346, 348, 359, 298

[56] References Cited

U.S. PATENT DOCUMENTS

| | | | |
|---|---|---|---|
| 2,014,573 | 9/1935 | Kliegl | 240/44.2 |
| 3,283,140 | 11/1966 | Rex | 240/25 |
| 4,799,136 | 1/1989 | Molnar | 362/217 |
| 4,816,974 | 3/1989 | Gordin | 362/261 |
| 4,864,476 | 9/1989 | Lemons et al. | 362/348 |
| 4,947,303 | 8/1990 | Gordin et al. | 362/261 |
| 5,016,150 | 5/1991 | Gordin et al. | 362/263 |
| 5,134,557 | 7/1992 | Gordin et al. | 362/261 |

*Primary Examiner*—Richard R. Cole
*Attorney, Agent, or Firm*—Beaman & Beaman

[57] ABSTRACT

An asymmetric luminaire for illuminating large outdoor areas, such as an athletic field, wherein glare and light spillage is minimized and controlled. The luminaire includes a reflecting surface of a generally parabolic configuration, and an arc light source is located within the luminaire, the length of the light source being disposed at approximately 45° with respect to the parabolic axis. A visor is used at the peripheral rim of the luminaire to control vertical and lateral light spillage, and the visor includes light source shields to prevent vertical spillage from the upper region of the luminaire. The luminaire reflecting surface includes a plurality of elliptical light reflecting ridges for restricting the near light beam height, and the upper portion of the reflecting surface can include substantially conical concentric light reflecting flute surfaces for accurately directing the light to target locations remote from the luminaire.

6 Claims, 2 Drawing Sheets

ASYMMETRIC SPORT LIGHTING LUMINAIRE

This is a continuation in part of co-pending application Ser. No. 07/915,240 filed Jul. 20, 1992 now abandoned.

BACKGROUND OF THE INVENTION

1. Field of the Invention

The invention pertains to sport lighting luminaires of the asymmetrical type wherein high efficiency of light placement is achieved with a minimum of glare and spillage by the use of an asymmetrical relationship between an arc light source and a parabolic luminaire reflecting surface, light restricting and directing surfaces being defined upon the luminaire reflecting surface, and a visor is used to control light spillage occurring directly from the lamp and from the lower portion of the luminaire without reducing beam utilization.

2. Description of the Related Art

The illumination of sports areas such as football fields, baseball diamonds, soccer fields, and the like, including parking lots, wherein a plurality of powerful luminaires are used to illuminate a particular area is becoming a complex science.

When illuminating athletic fields the area may require a uniform illumination intensity or density throughout the area, or when illuminating a baseball diamond it is desirable that different intensities of illumination be present at predetermined areas, for instance the infield is lighted brighter than the outfield. Powerful luminaires utilizing arc type light sources in conjunction with parabolic reflectors are commonly used for such outdoor lighting, and while such luminaires are capable of producing the desired degree of illumination, considerable problems, and controversy, have resulted due to the inadvertent illumination of adjacent areas. For instance, athletic fields are often located in or near residential areas, and the homeowners object to the high intensities of light being spilled upon their property or home.

The control of light spillage is largely accomplished by the us of glare shields built into the light source lamp, or the luminaire, which are intended to limit the light being cast to those areas intended. It is also known to use visors to control light spillage beyond the remote areas being illuminated, and lens configurations may also be employed. These devices generally also reduce the amount of light delivered to the desired area and thus reduce beam utilization.

As any area directly exposed to the luminaire light source will be illuminated, it is known to locate the light source within the luminaire in such a manner as to reduce lateral light spillage, such as shown in U.S. Pat. Nos. 4,947,303 and 5,016,150. In the art of controlling and eliminating light spillage it is desirable that all areas surrounding the area to be illuminated are not directly exposed to the light source.

The assignee has used special shapes and configurations within the luminaire reflecting surface to direct and confine the light beam as shown in U.S. Pat. No. 4,864,476, and the adapting the concepts shown in this patent permit the light being cast upon areas at different distances from the luminaire to be controlled and regulated, and the present invention employs concepts of this patent, but goes beyond its teaching to provide an even improved ability to control light spillage without reducing beam utilization.

SUMMARY OF THE INVENTION

Objects of the Invention

It is an object of the invention to provide an asymmetrical lighting luminaire which is capable of casting light upon a large area in a controlled beam wherein light spillage outside of the illuminated area is substantially eliminated without reducing beam utilization.

Another object of the invention is to provide an asymmetrical lighting luminaire using an arc type light source in conjunction with a parabolic reflecting surface wherein the reflecting surface includes configurations particularly suitable for controlling the height of a light beam at close and removed proximities from the luminaire, and wherein a single luminaire is capable of providing uniform light density over a large area with a minimum of spillage and maximum beam utilization.

Yet another object of the invention is to provide an asymmetric lighting luminaire characterized by its low light spillage wherein a visor is used with the luminaire to prevent spillage beyond the intended illuminated area and wherein the visor includes baffles to prevent direct exposure of the light source to areas beyond that intended to be illuminated.

In the practice of the invention, a luminaire is of a convex-concave configuration having a parabolic inner concave reflecting surface.

The lower portion of the reflecting surface is provided with a plurality of adjacent elliptical shaped ridges having a major axis disposed in a vertical direction, and such depressions tend to narrow the beam of light in relationship to the height and then cast upon the area being illuminated which is closest to the luminaire support. The upper portion of the reflecting surface can consist of a plurality of concentric substantially conical light reflecting flute surfaces capable of efficiently projecting the light in wider vertical beamspreads without increasing the vertical beam width above maximum centerbeam. The resultant beam efficiently directs light out onto the surface where illumination is desired.

The lamp utilized with the luminaire is preferably of the arc type wherein the light source constitutes an arc and a longitudinal axis which is substantially offset 45° with respect to the longitudinal axis of the parabolic luminaire reflecting surface. The central portion of the arc light surface is located slightly below, and in front of the focal point for the parabolic reflecting surface.

To prevent light spillage, and also restrict the distance directly exposed to the light source, a visor is attached to the peripheral rim of the reflector having an upper portion extending forwardly from the rim upper portion and lateral portions extending from the peripheral rim lateral portions thereby restricting lateral spillage. In order to restrict the distance of the light being cast directly in front of the luminaire the visor includes a first baffle spaced from the upper portion of the visor and so located as to prevent light being cast beyond the desired area to be illuminated when the luminaire is installed at the predetermined angular orientation to the vertical. Further, the efficiency of the visor to control light spillage is increased by the use of secondary light shielding baffle located between the primary baffle and the upper portion of the visor. The baffles are of a sheet material whose narrow dimension is substantially parallel to the direction of the light being cast. The visor and baffles thus block light spillage outside the desired beam without blocking light within the beam.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
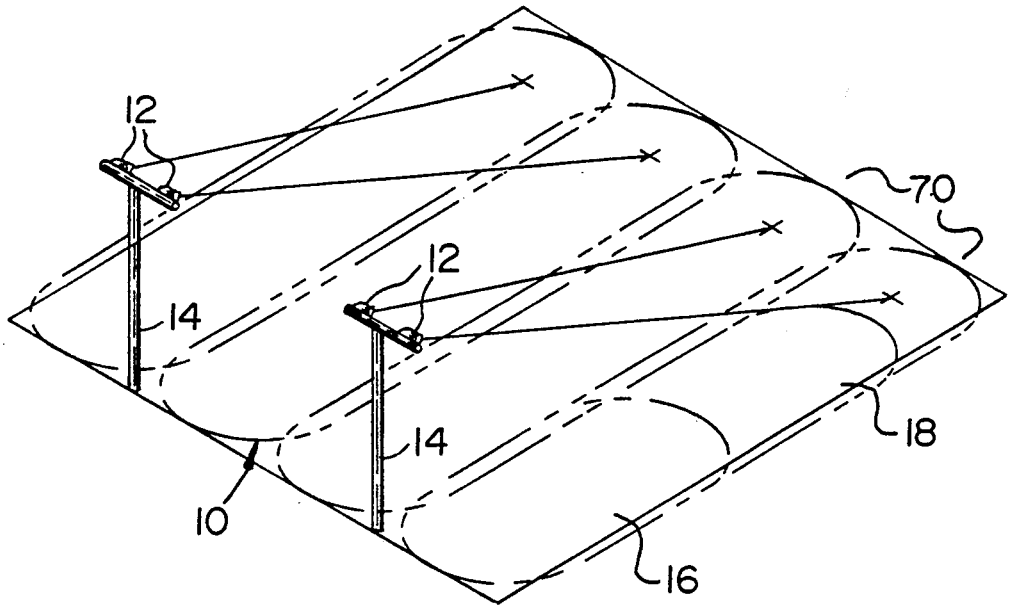
FIG. 1 is a perspective schematic view illustrating a typical distribution of light over a playing area utilizing the asymmetric luminaires of the invention.

FIG. 1 illustrates a typical athletic field schematically represented at 10 illuminated by a plurality of luminaires 12, four being illustrated. Each of the luminaires illuminates approximately a quarter of the area 10. The luminaires 12 are mounted upon poles 14, each pole including a crossarm, two luminaires being mounted upon each crossarm. That area closest to the associated luminaire is represented by numeral 16, while the more remote area being illuminated is indicated at 18.

Figure 2:
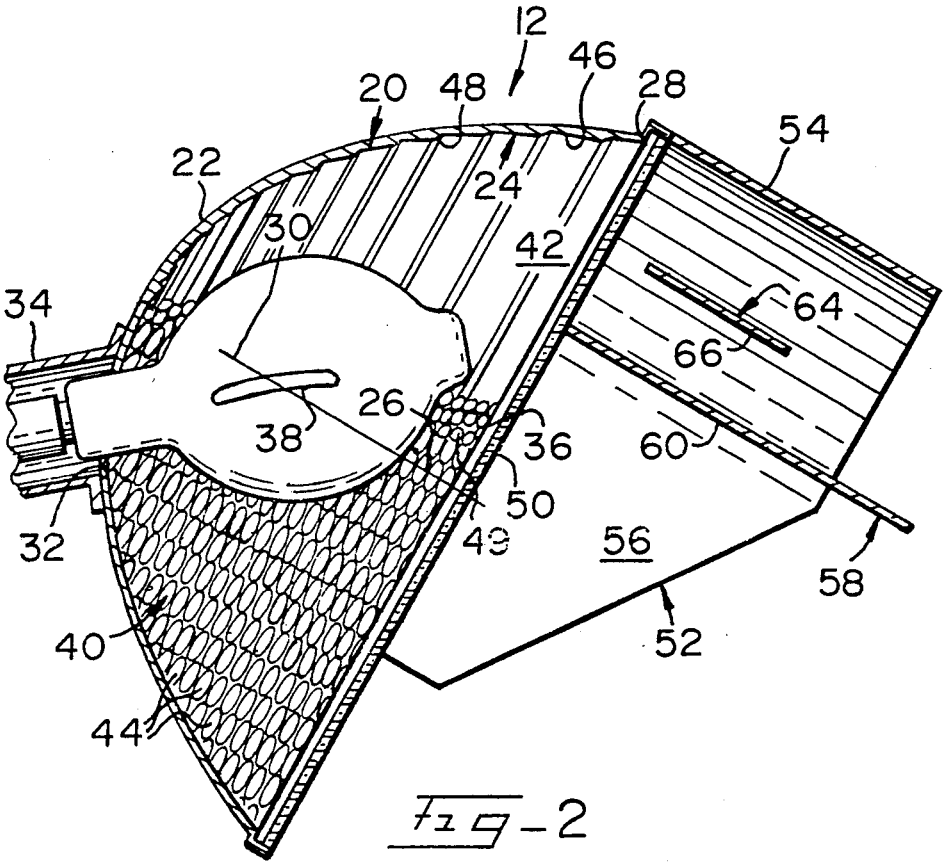
FIG. 2 is an elevational diametrical sectional view of a luminaire in accord with the invention.

With reference to FIG. 2, the luminaire 12 includes a reflector 20 formed of aluminum or the like, and may be spun or otherwise fabricated having an outer convex surface 22 and an inner concave reflecting surface 24. The reflector 20 includes a longitudinal axis 26 and a circular peripheral rim 28. The reflector is preferably of a parabolic configuration and the reflector surface 20 has a focal point at 30.

An opening 32 is defined in the reflector 20 asymmetrically related to the axis 26, and a cylindrical neck 34 is attached to the outer surface 22 to form the means for attaching the reflector to its support structure, such as a crossarm or the like. The lamp bulb 36 includes a stem which extends into the neck 34 and the lamp is electrically connected to the appropriate circuit, not shown, for permitting energizing of the arc tube 38. The arc tube 38 is of a longitudinal configuration disposed at approximately 45° to the axis 26 and has a central region defining the maximum light source intensity.

The reflector reflecting surface 24 includes a lower region 40, and an upper region 42. At the lower region 40, the surface 24 is provided with a plurality of elliptical ridges or projections 44 capable of reflecting light emitting from the arc tube 38. The ridges 44 each include a major axis disposed in a vertical direction upon proper mounting of the luminaire 12, and the light control aspects of the ridges 44 will be appreciated from the description in the assignee's U.S. Pat. No. 4,864,476.

The upper region 42 of the reflecting surface 24 can be provided with a plurality of concentric substantially conical flute surfaces 46 separated by steps 48. Throughout 20° of the flutes 46 above the ridges 44 the flutes 46 are formed with a plurality of elliptical ridges 49 having a major axis substantially concentrically related to the reflector axis and substantially conforming to the configuration of the associated flute. The major dimension of the ridges 49 in the circumferential direction is substantially twice that of the depression minor dimension, which is radially disposed, FIG. 3. The flutes 46 and ridges 49 reflect light from the luminaire 12 in an alternate manner than the ridges 44, and the light reflecting characteristics of the flutes 46, ridges 44 and ridges 49 will also be appreciated from the description in the assignee's U.S. Pat. No. 4,864,476 wherein these components are described in greater detail.

A clear tempered glass lens 50 is mounted upon the reflector peripheral rim 28, and the lens 50 defines a chamber within the reflector 20 preventing dirt, birds, insects, and the like, from entering the reflector.

Figure 5:
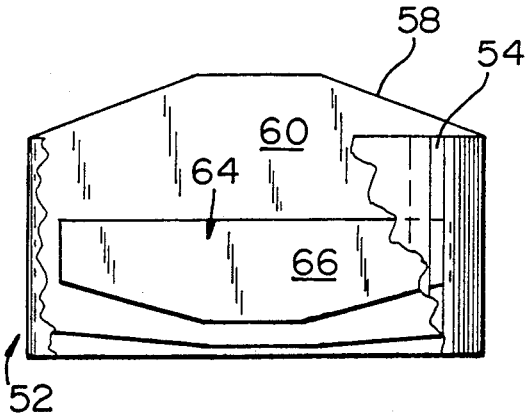
FIG. 5 is a top plan view of the visor, per se, partially broken away.
Figure 6:
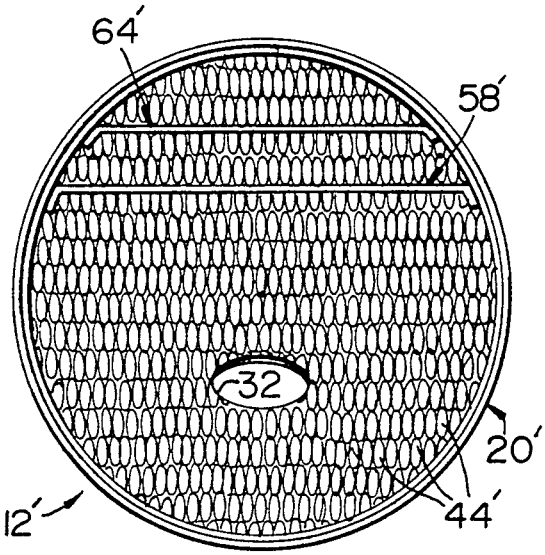
FIG. 6 is a front view of a modification of a luminaire in accord with the invention as taken as viewed from the reflector axis, the lamp being removed.

In addition to the light directional control achieved by the ridges 44 and 49 and the flutes 46, a visor 52 is also employed to prevent stray light from spilling into the area surrounding the field 10. The configuration of the visor 52 will best be appreciated from FIGS. 2, 5 and 6.

Figure 4:
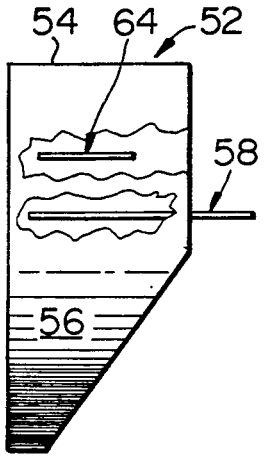
FIG. 4 is a side elevational side view of the visor utilized with the invention partially broken away.

The visor 52 includes an upper convex-concave portion 54 which merges into lateral portions 56. The configuration of the visor 52 is generally circular so as to conform to the configuration of the peripheral rim 28. As will be appreciated from FIGS. 2 and 4, the sheet metal visor 52 extends outwardly from the peripheral rim 28 and the lens 50, and the lateral portions 56 will prevent exposure of the arc tube 38 to those areas lateral of the direction in which the luminaire is aimed.

To increase the light shielding characteristics of the visor 52 a primary light baffle or shield 58 is mounted within the visor 52. The shield 58 includes a flat portion 60 having ears 62 formed at the ends thereof. The ears 62 are spot welded, riveted or otherwise fastened to the visor lateral portions 56 to support the shield 58 within the visor.

A secondary light shield 64 is interposed between the shield 58 and the visor upper portion 54. The shield 56 is smaller than the shield 58 and includes a flat portion 66 and ears 68 for attaching the secondary shield 64 to the visor.

As will be appreciated from FIG. 2, the central maximum light intensity region of the arc tube 38 is slightly below and forwardly of the focal point 30 with respect to the reflector peripheral rim 28. This positioning of the arc tube with respect to the reflecting surface 24 produces the most desirable light distribution, and the asymmetrical relationship between the length of the arc tube and the axis 26 of the surface 24 achieves the preferred illumination characteristics.

Light emitting from arc tube 38 reflected from ridges 44 will be directed at the field near area 16, FIG. 1, and the ridges 44 will maintain the light beam relatively narrow to minimize vertical light spillage. Further, the presence of the visor lateral portions 56 also prevents lateral light dispersion.

The light being reflected from the flutes 46 will be projected to the field near area 16, and this light is bent more across the center axis to provide a wider vertical beam without increasing spill above maximum center-beam. Lateral dispersion of the light reflected by flutes 46 is controlled by the visor lateral portions 56.

FIG. 2 illustrates the typical angular relationship of a luminaire 12 to the vertical during installation. As will be appreciated from FIG. 2, the length of the arc tube 38 is disposed at approximately 45° to the reflecting surface axis 26, and the axis 26 is angularly disposed to the vertical. This inclination of the reflector 20 would permit light spillage directly in line with the luminaire as represented at 70, FIG. 1, if the visor 52 was not present, and the extension of the visor 52 is sufficient to prevent the spillage of light into the area 70. However, to further control the maximum casting of light adjacent the areas 70 the primary light shield 58 and the secondary light shield 64 are employed whereby the filament 38 is no directly exposed to the area 70 which are not to be illuminated. As the shield flat portions 60 and 66 are substantially parallel to each other, parallel to the visor upper portion 54, and as the minimum dimension of the shields is substantially parallel, or at a desirable angle slightly oblique to parallel, to the light being reflected from the flutes 46, the shields 58 and 64 do not substantially interfere with the reflection of the light from the flutes 46, but the shields do prevent the light from obliquely passing through the lens 50 and visor 52. The shield 64, whose configuration is appreciated from FIG. 4, prevents light from obliquely passing through the visor between the outermost region of the visor and the innermost edge of the shield 58.

It will therefore be appreciated that the combination of the location of the arc tube 38 within the reflecting surface 24, the presence of the elliptical ridges 44 and the concentric flutes 46, the configuration of the visor 52, and the use of the shields 58 and 64 all permit an efficient casting of light from the luminaire 12 upon the field 10, but control the light beam so as to minimize spillage of the beam into those areas surrounding the field 10, which are not to be illuminated and thus achieve maximum beam utilization.

Figure 3:
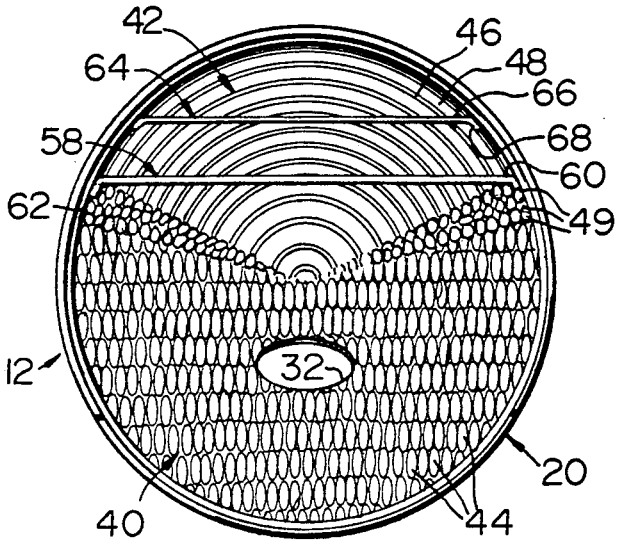
FIG. 3 is a front view of a luminaire in accord with the invention as taken as viewed from the reflector axis, the lamp being removed for purpose of illustration.

In the preferred embodiment of FIGS. 2 and 3, the ridges 44 are located at the lower region of the reflector.

It is within the concept of the invention that the entire inner reflector surface contain ridges and no flute surfaces be utilized. In this respect, reference is made to the assignee's U.S. Pat. No. 4,864,476 and FIG. 6 wherein equivalent components are indicated by primed reference numerals.

It is appreciated that various modifications to the inventive concepts may be apparent to those skilled in the art without departing from the spirit and scope of the invention.

We claim:

1. A lighting luminaire characterized by its confinement of stray light comprising, in combination, a convex-concave reflector having an inner concave light reflecting surface and a peripheral rim having upper and lateral portions, said reflecting surface having a longitudinal axis, a focal point, an upper portion and a lower portion, a tubular neck defined on said reflector having an axis inclined substantially 45° relative to said reflecting surface axis, a lamp having an axis and having an elongated arc light source having a longitudinal axis substantially parallel to said lamp axis and located within said reflector, said arc light source being located adjacent said reflecting surface focal point and its axis being inclined substantially 45° relative to said reflecting surface axis, said arc light being located within the confines of said reflecting surface as defined by said peripheral rim, a visor attached to said reflector at said peripheral rim having an upper portion extending from said reflector rim upper portion and lateral portions extending from said rim lateral portions, and a first flat light source shield mounted on said visor extending between said visor lateral portions and spaced from said visor upper portion having a plane substantially parallel to said reflecting surface axis, said reflecting surface lower portion including a plurality of adjacent convex elliptical ridges having a substantially vertical major axis whereby light reflected by said ridges will be confined to a beam of restricted height.

2. In a lighting luminaire as in claim 1, said reflecting surface upper portion comprising a plurality of substantially circular conical light reflecting surfaces substantially concentric to said reflecting surface longitudinal axis.

3. In a lighting luminaire as in claim 1, said reflecting surface being of a parabolic configuration, said arc light source being located slightly below and forward of said reflecting surface focal point in the direction of said reflector peripheral rim.

4. In a lighting luminaire as in claim 1, a second light source shield mounted on said visor located between said visor upper portion and said first light source shield, said second light source shield being substantially parallel to said first light source shield.

5. In a lighting luminaire as in claim 4, said first light source shield being substantially planar in configuration and formed of sheet material.

6. In a lighting luminaire as in claim 4, said first and second light source shields being substantially planar and formed of sheet material.

* * * * *